US009862526B1

(12) United States Patent
Holzer

(10) Patent No.: US 9,862,526 B1
(45) Date of Patent: Jan. 9, 2018

(54) BIASED LID SUPPORT DEVICE

(71) Applicant: Robert W. Holzer, Maple Grove, MN (US)

(72) Inventor: Robert W. Holzer, Maple Grove, MN (US)

( * ) Notice: Subject to any disclaimer, the term of this patent is extended or adjusted under 35 U.S.C. 154(b) by 534 days.

(21) Appl. No.: 14/578,380

(22) Filed: Dec. 20, 2014

(51) Int. Cl.
*B65D 43/16* (2006.01)

(52) U.S. Cl.
CPC ..... *B65D 43/164* (2013.01); *B65D 43/163* (2013.01); *B65D 43/165* (2013.01)

(58) Field of Classification Search
CPC .. B65D 43/165; B65D 43/163; B65D 43/164; B65D 43/16; B65D 2251/1008; A45C 13/007; E05D 11/1078; E05D 7/12; E05D 13/04; A47G 19/2266; Y10T 16/5402; Y10T 16/540256; Y10T 16/540257; Y10T 16/5478; Y10T 16/551; A47J 36/12
USPC ..... 16/279, 297
See application file for complete search history.

(56) References Cited

U.S. PATENT DOCUMENTS 2,664,490 A * 12/1953 Allgeyer ..... A47J 37/103 219/403
4,800,624 A * 1/1989 Whitefoot ..... E05D 5/062 16/332

* cited by examiner

*Primary Examiner* — Anthony Stashick
*Assistant Examiner* — James M Van Buskirk
(74) *Attorney, Agent, or Firm* — Dave Alan Lingbeck

(57) ABSTRACT

A biased lid support device for easy access to inside the containers by propping open the lids. The biased lid support device includes a biased support assembly including a bracket adapted to be coupled to a container and also including at least one biased element connected to the bracket and extending outwardly therefrom and adapted to be engagable with a lid pivotally attached to the container, wherein the bracket includes an elongate planar base portion having a planar surface and opposed ends and adapted to be securely coupled to the container.

4 Claims, 5 Drawing Sheets

BIASED LID SUPPORT DEVICE

BACKGROUND OF THE INVENTION

Field of the Invention

The present invention relates to lid supports and more particularly pertains to a new biased lid support device for easy access to inside the containers by propping open the lids.

Description of the Prior Art

The use of lid supports is known in the prior art. More specifically, lid supports heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a trash container lid system for placement on top of large industrial trash bins of the type utilized in hotels, apartment houses, etc., in which a lid section is rotatably coupled to a trash bin via lever arms rotatably coupled at one end to the sides of the trash bin and at another end to the back of the lid section. A pair of brace members are fixedly attached to the outer surfaces of the sides of the lid and extend downwardly, each being in physical abutment with one of the lever arms. Another prior art includes a tube assembly including an upper component having a downwardly extending section received within the upper end of the main body portion. The upper component has an upwardly extending section and a transitional section coupling the upwardly and downwardly extending sections. The tube assembly includes a lower component having an upwardly projecting section received within the lower end of the main body portion and downwardly projecting sections. Also another prior art includes a means for lifting the top consisting of at least one leaf spring, one of whose ends is fixed to the base and the other of whose ends is able to slide on the bowl of the top, the leaf spring being under tension when the top is closed, and being relaxed or partially relaxed when the top is in the fully open position. While these devices fulfill their respective, particular objectives and requirements, the aforementioned patents do not disclose a new biased lid support device.

SUMMARY OF THE INVENTION

The general purpose of the present invention, which will be described subsequently in greater detail, is to provide a new biased lid support device which has many of the advantages of the lid supports mentioned heretofore and many novel features that result in a new biased lid support device which is not anticipated, rendered obvious, suggested, or even implied by any of the prior art lid supports, either alone or in any combination thereof. The present invention includes a biased support assembly including a bracket adapted to be coupled to a container and also including at least one biased element connected to the bracket and extending outwardly therefrom and adapted to be engagable with a lid pivotally attached to the container, wherein the bracket includes an elongate planar base portion having a planar surface and opposed ends and adapted to be securely coupled to the container. None of the prior art includes the combination of the elements of the present invention.

There has thus been outlined, rather broadly, the more important features of the biased lid support device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new biased lid support device which has many of the advantages of the lid supports mentioned heretofore and many novel features that result in a new biased lid support device which is not anticipated, rendered obvious, suggested, or even implied by any of the prior art lid supports, either alone or in any combination thereof.

Still another object of the present invention is to provide a new biased lid support device for easy access to inside the containers by propping open the lids.

Still yet another object of the present invention is to provide a new biased lid support device that allows a user to at least partially open a lid on a container so that the user can access the inside of the container without having to hold the lid.

Even still another object of the present invention is to provide a new biased lid support device that allows the user to open and close a lid without having to first insert a support between the lid and the container and then remove the support to close the lid on the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
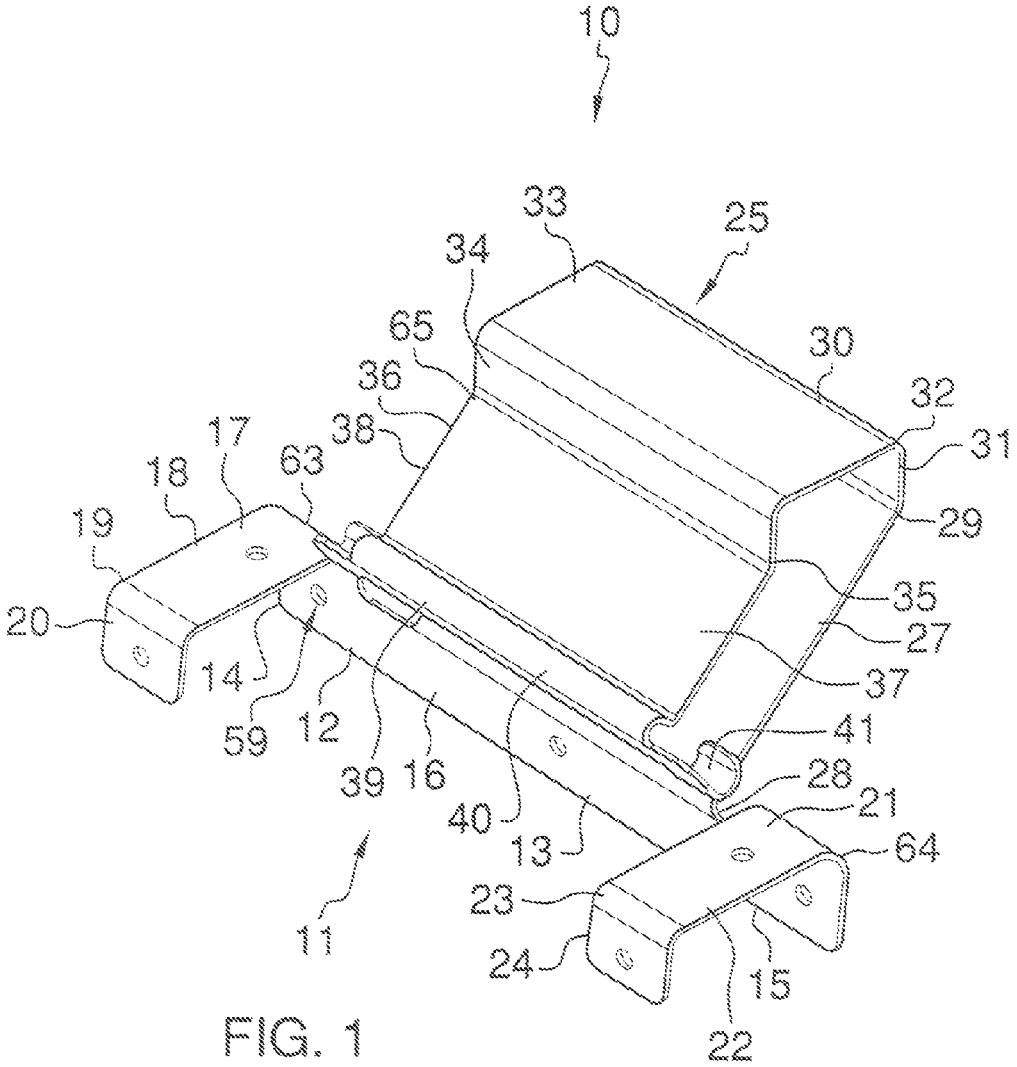
FIG. 1 is a front perspective view of a new biased lid support device according to the present invention.

With reference now to the drawings, and in particular to FIGS. 1 through 5 thereof, a new biased lid support device embodying the principles and concepts of the present invention and generally designated by the reference numeral 10 will be described.

As best illustrated in FIGS. 1 through 5, the biased lid support device 10 generally may comprise a biased support assembly 11 including a rigid bracket 12 adapted to be coupled to a container 60 and also including one or more biased elements 25, 26 integrally connected to the bracket 12 and extending outwardly therefrom and adapted to be engagable with a lid 61 pivotally attached to the container 60. The bracket 12 may include a rigid elongate planar base portion 13 having a planar surface 16, holes 59 disposed therethrough, and opposed ends 14, 15 and adapted to be securely coupled to the container 60. The bracket 12 may also include a pair of appendages 17, 21 each integrally connected at a respective end 14, 15 of and extending outwardly from the base portion 13. Each of the appendages 17, 21 may have a planar main portion 18, 22 having a proximate end 63, 64 integrally attached to the base portion 13 and also having a distal end 19, 23 with the planar main portion 18, 22 extending perpendicular to the base portion 13. Each of the appendages 17, 21 may also have a planar end portion 20, 24 integrally attached to and angled from the distal end 19, 23 of a respective main portion 18, 22 and also spaced from and extending parallel to the base portion 13 with the bracket 12 adapted to receive a portion of a wall 62 of the container 60 between the base portion 13 and the end portions 20, 24.

As shown in FIG. 1, the one or more biased elements 25, 26 may include a rigid planar cantilever 27 having a width and length and a proximate end 28 integrally attached to the base portion 13 between the appendages 17, 21 and extending outwardly therefrom and also having a distal end 29. The one or more biased elements 25, 26 may also include a connector 30 integrally attached at the distal end 29 of the cantilever 27 and may further include a spring 36 integrally connected to the connector 30 and spacedly and depressibly overlaying the cantilever 27 and adapted to support the lid 61 in an open position relative to the container 60. The cantilever 27 may extend at an angle relative to the planar surface 16 of the base portion 13.

Figure 2:
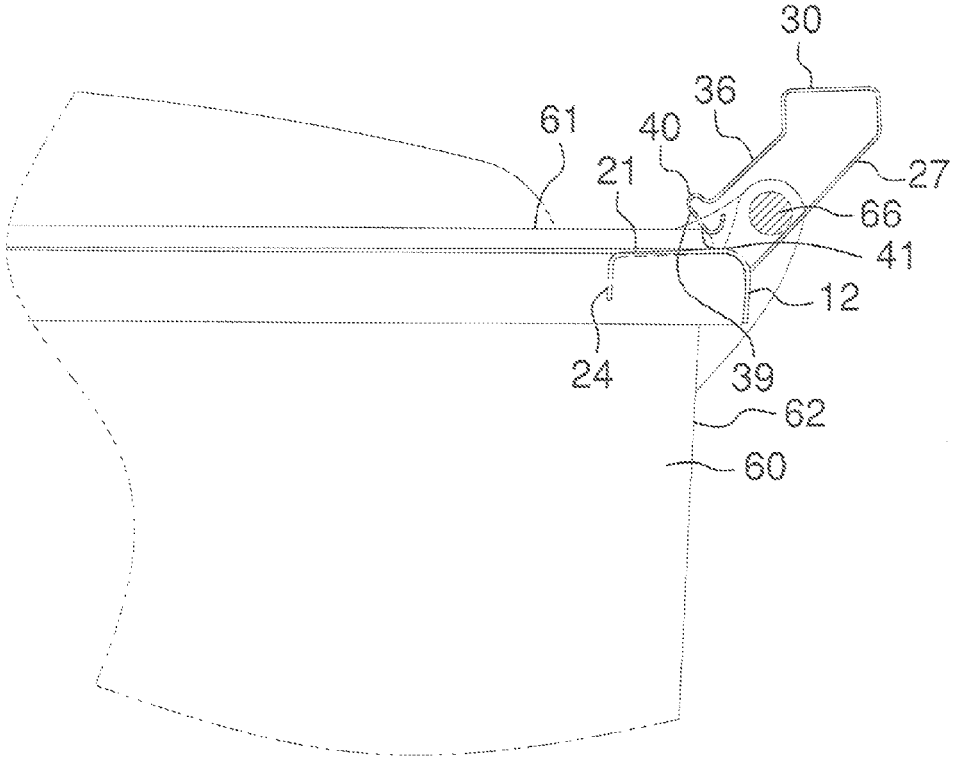
FIG. 2 is a side elevation view of the present invention in use with a dumpster.
Figure 3:
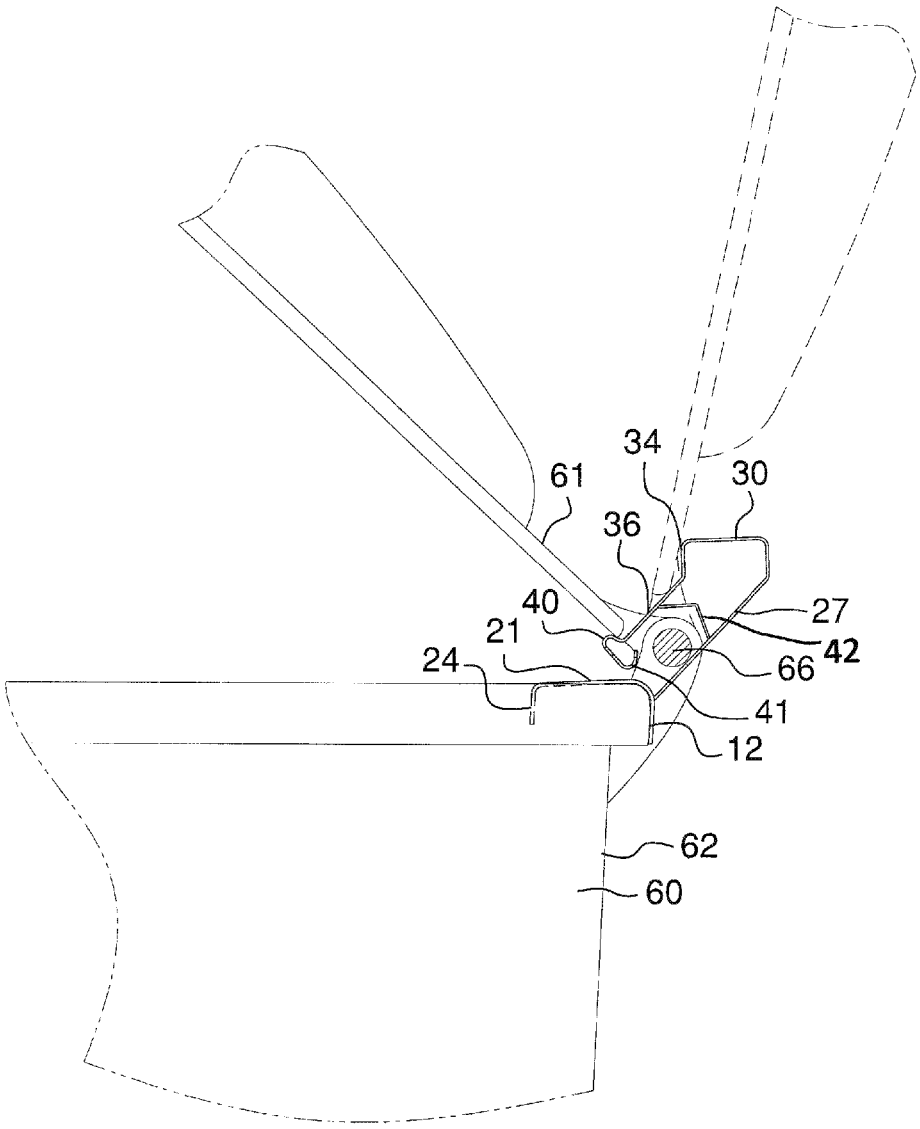
FIG. 3 is a side elevation view of the present invention in use with the lid propped open upon the container and also showing how far the lid can swing open relative to the container in dashes.

As shown in FIGS. 1-3, the connector 30 may have a first planar end portion 31 integrally attached to the distal end 29 of the cantilever 27 and extending at an angle relative to the cantilever 27 and extending parallel to the base portion 13 of the bracket 12, and also has an intermediate planar portion 33 integrally attached to and extending from an outer end 32 of the first planar end portion 31 and extending generally parallel to the main portions 18, 22 of the appendages 17, 21, and may further have a second planar end portion 34 opposite to the first planar end portion 31 and integrally attached to and extending from the intermediate planar portion 33 and extending parallel to the base portion 13 of the bracket 12 and forming a lid stopper to limit how far the lid 61 can open relative to the container 60. The spring 36 may include a planar main portion 37 having an outer surface 38 facing away from the cantilever 27 and a first end 65 integrally coupled to an outer end 35 of the second planar end portion 34 of the connector 30 with the planar main portion 37 extending parallel to the cantilever 27. The spring 36 may also include a distal end portion 39 integrally extending from the planar main portion 37 of the spring 36 and being engagable to and hold the lid 61 in an open position relative to the container 60. The distal end portion 39 of the spring 36 may include a rounded projecting portion 40 extending outwardly from the outer surface 38 of the planar main portion 37 forming a transverse ledge across the spring to engage the lid 61 and hold the lid 61 in an open position, and may also include an end portion 41 which integrally loops from the projecting portion 40 back towards the cantilever 27 and extends between the planar main portion 37 of the spring 36 and the cantilever 27 and curves toward the planar main portion 37 of the spring 36 forming a restrictor to limit how far the spring 36 can be depressed towards the cantilever 27. The biased support assembly 11 may further include a biased resistance member 42 compressibly, engageably and integrally disposed between the cantilever 27 and the spring 36 to provide resistance to the spring 36 when supporting the lid 61.

Figure 4:
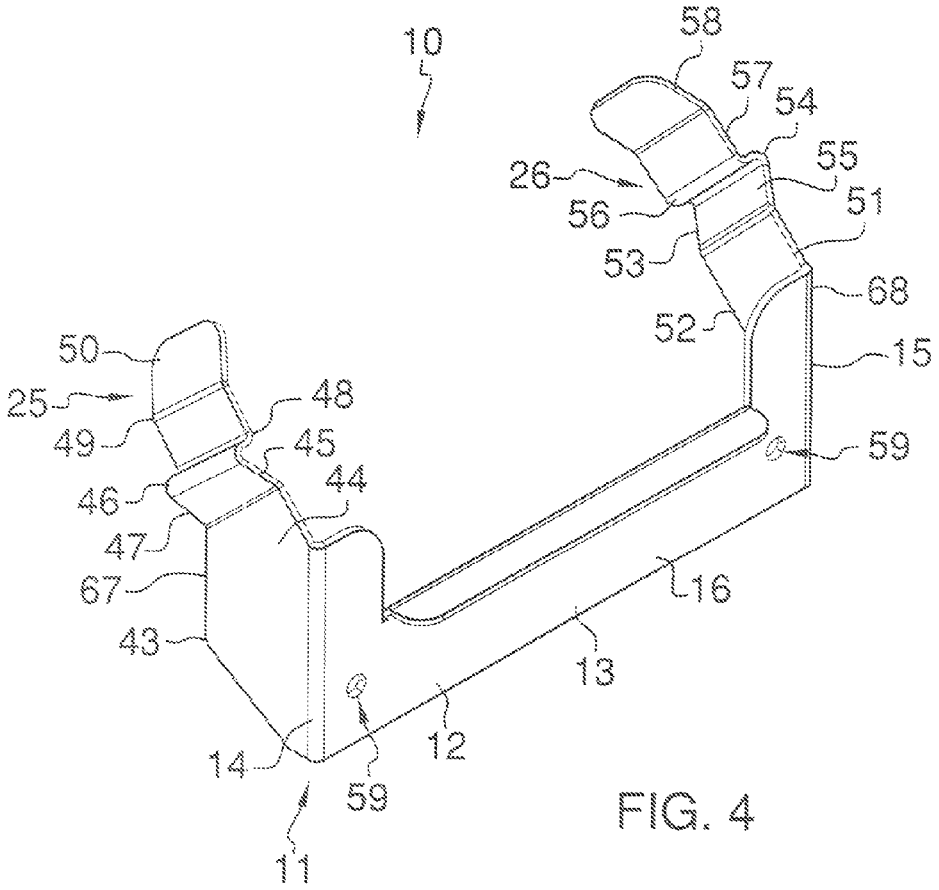
FIG. 4 is a perspective view of a second embodiment of the present invention.
Figure 5:
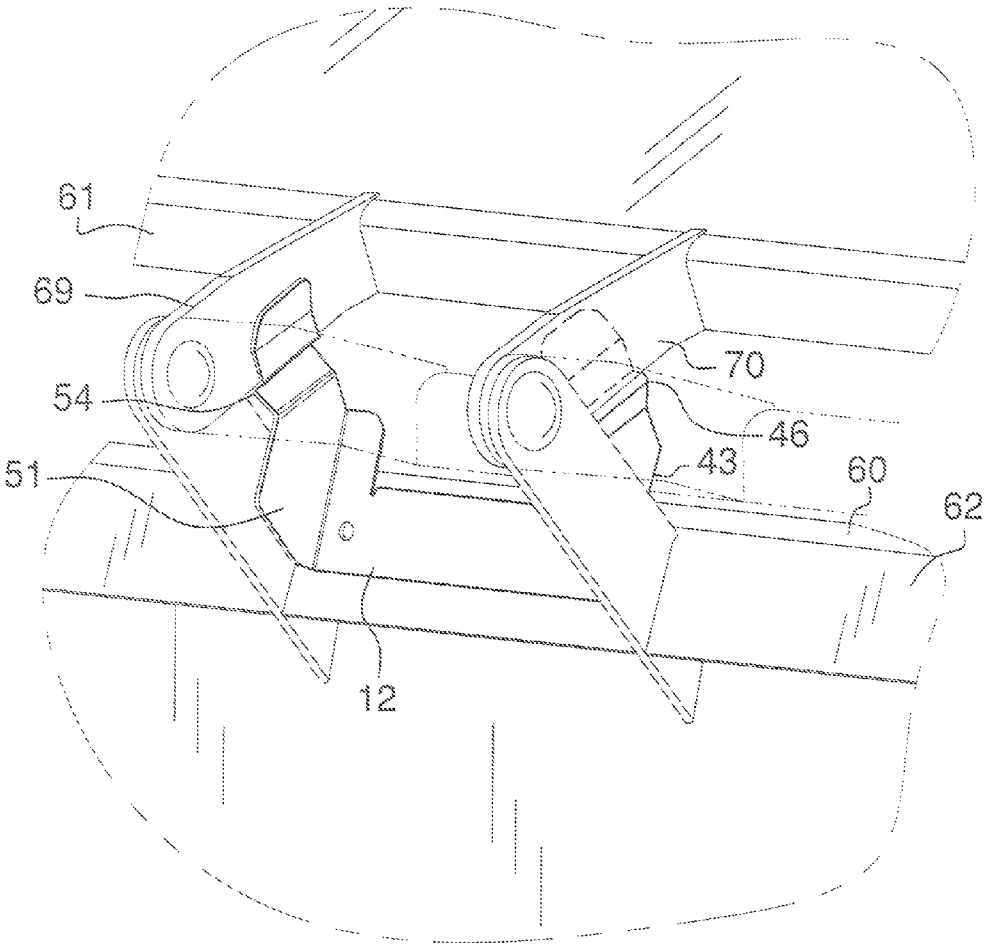
FIG. 5 is a rear perspective view of a second embodiment of the present invention in use with a dumpster.

As shown in FIGS. 4-5, as a second embodiment, the one or more biased elements 25, 26 may include a pair of spaced cantilevered springs 43, 51 each integrally attached to a respective end 15, 15 of the planar base portion 13 and extending outwardly therefrom and having an outer side 67, 68 facing away from the base portion 13 of the bracket 12 and the opposed cantilevered spring 43, 51. Each of the cantilevered springs 43, 51 may include a planar support portion 44, 52 integrally attached to and extending outwardly perpendicular to the planar base portion 13 of the bracket 12. Each of the cantilevered springs 43, 51 may also include an intermediate portion 45, 53 integrally connected to the planar support portion 44, 52 and having a projecting portion 46, 54 extending outwardly of the outer side 67, 68 of a respective cantilevered spring 43, 51 and away from the base portion 13 of the bracket 12 and forming a transverse ledge for engaging a lid bracket 69, 70 supporting the lid 61 in an open position. The projecting portion 46, 54 of the respective cantilevered spring 43, 51 may include a first portion 47, 55 integrally connected to the planar support portion 44, 52 and slanted outwardly of the outer side 67, 68 and away from the planar support portion 44, 52 of the respective cantilevered spring 43, 51, and may also include a second portion 48, 56 integrally connected to the first portion 47, 55 and slanted outwardly of the outer side 67, 68 and towards the planar support portion 44, 52 of the respective cantilevered spring 43, 51 to form the transverse ledge with the second portion 48, 56 being engagable to the lid 61 in an open position. Each of the cantilevered springs 43, 51 may further include a distal end portion 49, 57 integrally connected to the intermediate portion 45, 53 and having an outer portion 50, 58 slanted inwardly towards the opposed cantilevered spring 43, 51 to allow a user to manipulate and move the respective cantilevered spring 43, 51 as desired.

In use, the user conventionally attaches the bracket 12 to a container 60 having a removable and pivotable lid 61 by inserting fasteners through the holes 59 of the bracket 12. The bracket 12 may be conventionally attached along a top edge of the wall 62 of the container 60 with the one or more biased elements 25, 26 extending outwardly above the top edge of the wall 62. For the first embodiment, an elongate lid support member 66 or rod may be disposed between the cantilever 27 and the spring 36. For the second embodiment, the cantilevered springs 43, 51 may be positioned adjacent to and engagable with the lid support brackets 69, 70 supporting the lid 61. To gain access to inside the container 60, the user opens the lid 61 relative to the container 60 with the lid 61 engaging the one or more biased elements 25, 26 in an open position. The lid 61 engages the one or more projecting portions 40, 46, 54 in the open position with the lid 61 remaining open and the lid stopper, for the first embodiment, prevents the user from flipping the lid 61 over the back of the container 60. The user may close the lid 61 upon the container 60 by disengaging the lid 61 from the one or more projecting portions 40, 46, 54 and closing the lid 61 upon the container 60 when access to the inside of the container 60 is no longer needed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the biased lid support device. Further, since numerous modifications and changes will readily occur to those skilled in the art, it is not desired to limit the invention to the exact construction and operation shown and described, and accordingly, all suitable modifications and equivalents may be resorted to, failing within the scope of the invention.

I claim:

1. A biased lid support device comprising:

a biased support assembly including a bracket adapted to be coupled to a container and also including at least one biased element connected to the bracket and extending outwardly therefrom and adapted to be engagable with a lid pivotally attached to the container, wherein the bracket includes an elongate planar base portion having a planar surface and opposed ends and adapted to be securely coupled to the container, wherein the bracket also includes a pair of appendages each connected at a respective said end of and extending outwardly from the base portion and having a main portion, wherein the at least one biased element includes a planar cantilever having a proximate end attached to the base portion between the appendages and extending outwardly therefrom and also having a distal end, and also includes a connector attached at the distal end of the cantilever and further includes a spring connected to the connector and spacedly and depressibly overlaying the cantilever and adapted to support the lid in an open position relative to the container, wherein the connector has a first planar end portion attached to the distal end of the cantilever and extending at an angle relative to the cantilever and extending parallel to the base portion of the bracket, and also has an intermediate planar portion attached to and extending from an outer end of the first planar end portion and extending generally parallel to the main portions of the appendages, and further has a second planar end portion opposed to and spaced from the first planar end portion and attached to and extending from the intermediate planar portion and extending parallel to the base portion of the bracket and forming a lid stopper to limit how far the lid can open relative to the container.

2. The biased lid support device as described in claim 1, wherein the spring includes a planar main portion having an outer surface facing away from the cantilever and a first end coupled to an outer end of the second planar end portion of the connector with the planar main portion extending parallel to the cantilever, wherein the spring also includes a distal end portion attached to and extending from the planar main portion of the spring to engage and hold the lid in an open position relative to the container.

3. The biased lid support device as described in claim 2, wherein the distal end portion of the spring includes a rounded projecting portion extending outwardly from the outer surface of the planar main portion forming a transverse ledge across the spring and being engagable to the lid and hold the lid in an open position, and also includes an end portion which loops from the projecting portion back towards the cantilevered portion and extends between the planar main portion of the spring and the cantilever and curves toward the planar main portion of the spring forming a restrictor to limit how far the spring can be depressed towards the cantilever.

4. The biased lid support device as described in claim 3, wherein the biased support assembly further includes a biased resistance member compressibly and engageably disposed between the cantilever and the spring to provide resistance to the spring when supporting and engaging the lid.

* * * * *